United States Patent [19]

Price

[11] 4,213,615

[45] Jul. 22, 1980

[54] BOARD GAME WITH MOVABLE PLAYING PIECES

[76] Inventor: Howard C. Price, 7 Crump St., Huntington, W. Va. 25705

[21] Appl. No.: 927,608

[22] Filed: Jul. 24, 1978

[51] Int. Cl.[2] ..... A63F 3/02

[52] U.S. Cl. ..... 273/260; 273/288

[58] Field of Search ..... 273/258, 262, 255, 260, 273/242, 261

[56] References Cited

U.S. PATENT DOCUMENTS

| | | | |
|---|---|---|---|
| 383,653 | 5/1888 | Monks | 273/258 |
| 604,401 | 5/1898 | Lang | 273/242 |
| 2,772,885 | 12/1956 | Wales | 273/258 |
| 3,863,927 | 2/1975 | Moritz | 273/258 |
| 3,929,337 | 12/1975 | Hayes | 273/260 |

*Primary Examiner*—Richard T. Stouffer
*Assistant Examiner*—R. Carl Moy
*Attorney, Agent, or Firm*—Bacon & Thomas

[57] ABSTRACT

This invention relates to board games with movable playing pieces. More particularly, this invention relates to chess-type board games with movable playing pieces wherein the playing pieces are moved in accordance with selected patterns by one player in order to capture playing pieces of another player.

5 Claims, 5 Drawing Figures

Fig. 3.
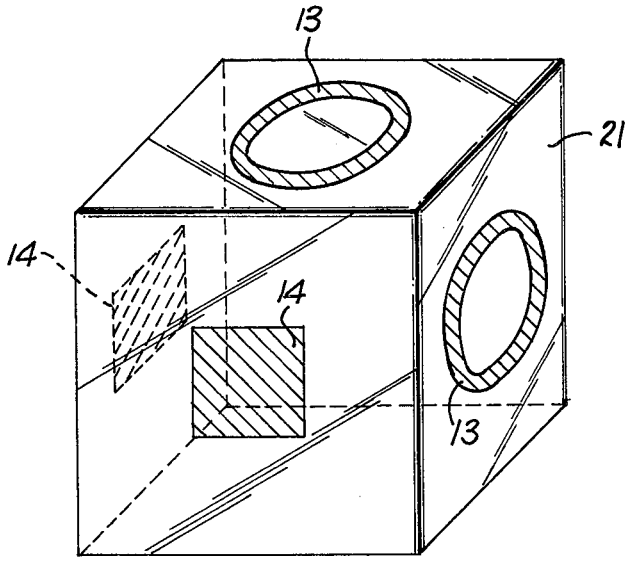
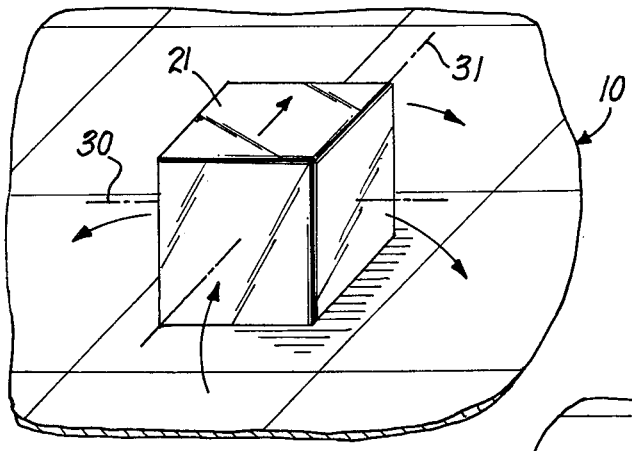
Fig. 4.
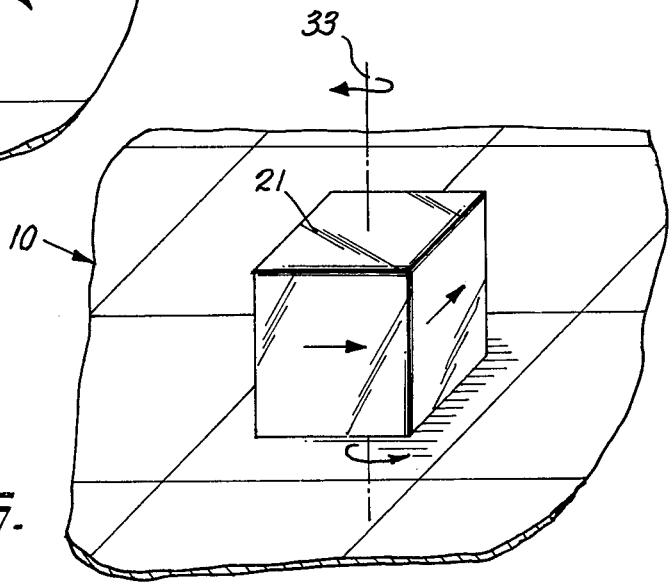
Fig. 5.

BOARD GAME WITH MOVABLE PLAYING PIECES

BACKGROUND AND PRIOR ART

There are many board games in which players move playing pieces according to selected restraints in order to capture the playing pieces of other players. Various types of chess and checker games have been devised in which it is necessary to use only a playing board which is divided into an array of squares and playing pieces which are moved over those squares. In order to add interest to these games, many of them utilize accessories such as dice, playing cards, spinners or the like in order to establish relationships between the playing pieces and the spaces on the boards.

Generally, most chess and checker games are played in two dimensions and the pieces are merely slid or jumped from one space to another. The pieces themselves, in most games, do not have any interesting function of their own which enhances the interest of the game.

In view of the aforementioned considerations, there is a need for a new kind of chess-type game in which playing pieces themselves assume a more interesting role.

OBJECTS OF THE INVENTION

It is an object of the instant invention to provide a new and improved board game with playing pieces.

It is a further object of the instant invention to provide a new and improved board game with playing pieces wherein only a playing board and the playing pieces are utilized in accordance with certain instructions, no other accessory devices being necessary.

It is a further object of the invention to provide a new and improved board game with playing pieces wherein the board game resembles chess or checkers and therefore can be easily mastered by anyone familiar with chess or checkers.

It is a further object of the instant invention to provide a new and improved chess or checker type of game, having many of the challenges of chess and checkers, wherein the game can be readily learned by children and yet is found to be interesting to both children and adults.

It is a further object of the instant invention to provide a new and improved chess or checker-type game wherein the playing pieces are moved in a manner other than simply sliding or jumping across a board in order to move from one space to another on the board.

SUMMARY OF THE INVENTION

In view of the aforementioned objects, and other objects, the instant invention contemplates a playing board which is divided into a plurality of spaces and a plurality of playing pieces having distinct surfaces, at least some of which are identified by specific indicia. The game is played by rolling and twisting a playing piece over the surface of the board in order to match indicia on opposing playing pieces. When one player moves his playing piece to match indicia with another player, the moving player obtains an advantage in the game.

BRIEF DESCRIPTION OF THE DRAWINGS

FIG. 3 is an enlarged perspective view of a single playing piece showing indicia on various sides thereof;

FIG. 4 is a perspective view of a single playing piece undergoing a rolling motion move; and FIG. 5 is a perspective view of a single playing pieces undergoing a twisting motion move.

DETAILED DESCRIPTION

Figure 1:
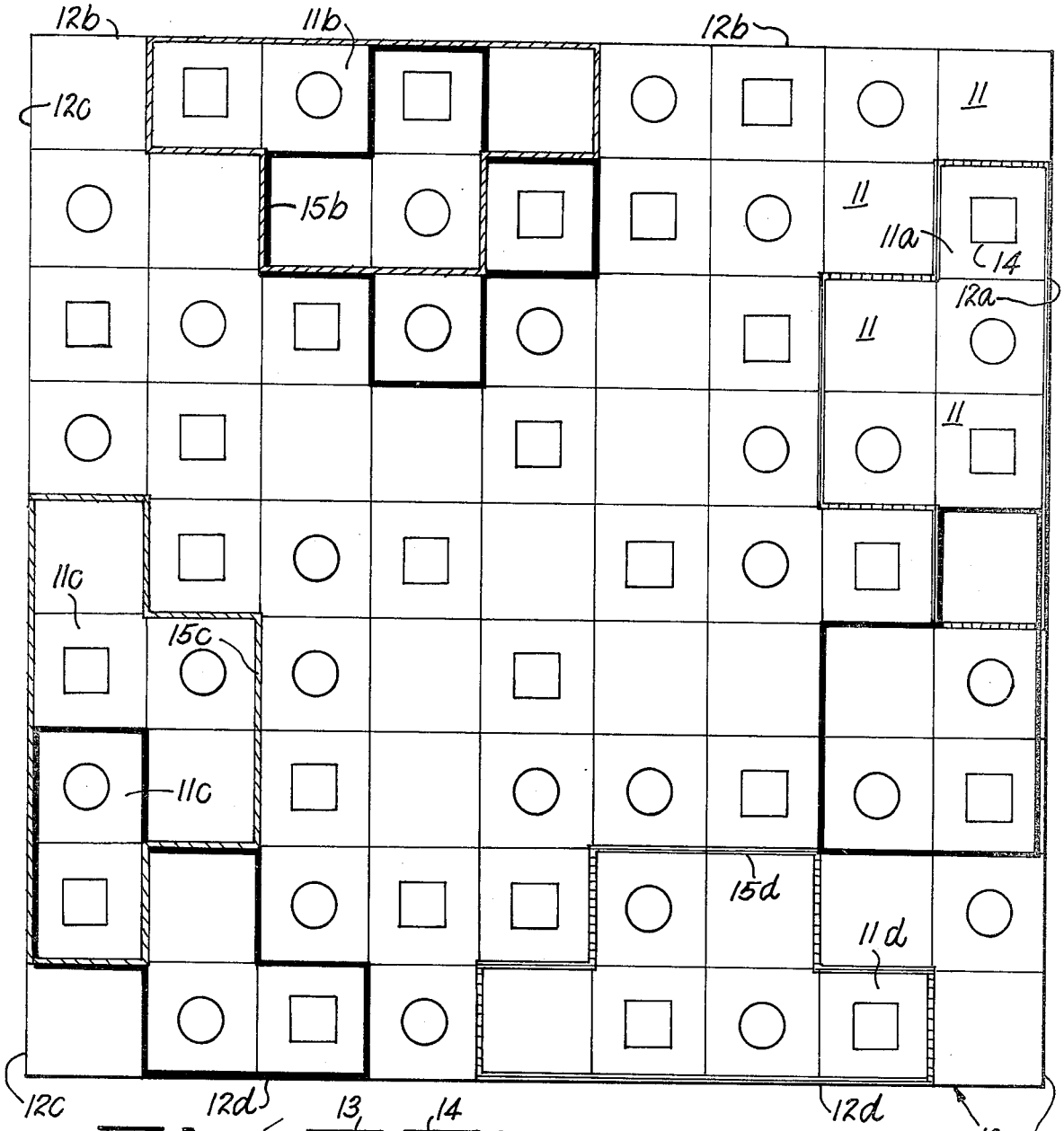
FIG. 1 is a planar view of the playing boards of the instant invention.

Referring now to FIG. 1, there is shown a square playing board 10 which is divided into eighty-one square spaces 11 each having the same area so that there are nine spaces along each of four edges 12*a*, 12*b*, 12*c* and 12*d* of the playing board. Some of the squares 11 are left blank while other squares have indicia therein. In the illustrated embodiment, the indicia are in the form of circles 13 and small squares 14. For the purposes of the illustrated embodiment, it is only necessary that there be three types of squares identified by various indicia. For the purposes of convenience, some squares are marked with circles 13 and others are marked with the squares 14, while the remaining squares are left blank.

As can be seen in FIG. 1, some groupings of squares are outlined by lines of various colors. A first grouping 11*a* is outlined by a red line 15*a*, a second grouping 11*b* is outlined by a yellow line 15*b*, a third grouping 11*c* is outlined by a green line 15*c* and a fourth grouping 11*d* is outlined by a blue line 15*d*. Three of the groupings 11*a*–11*c* have a further partially overlapping grouping outlined by relatively heavy black lines 16*a*–16*c* associated with three sides of 12*a*–12*c* of the board 10 with sides 12*c* and 12*d* being overlapped. The purpose of the outlines 15*a*–15*d* and 16*a*–16*c* will be explained hereinafter when the method of playing the game is explained.

Figure 2:
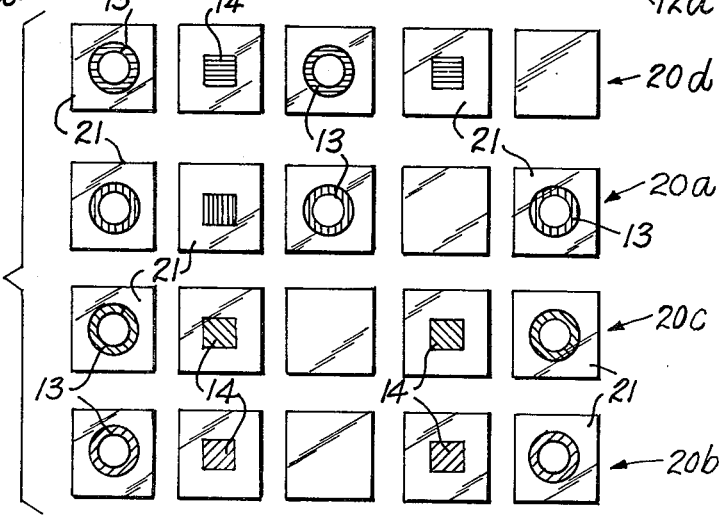
FIG. 2 is a top view showing four sets of playing pieces which are color coded with starting areas on the board.

As is seen in FIG. 2, there are four groups of playing pieces 20*a*–20*d* associated with each edge of the board. Each one of the groups 20*a*–20*d* is associated with a separate player and each group is identified by a specific color. In other words, the playing pieces 20*a* are identified by red markings, those in 20*b* are identified by yellow markings, those in 20*c* are identified by green markings and those in 20*d* are identified by blue markings.

Referring now to FIG. 3, there is shown an enlarged view of a single playing piece 21. Each playing piece 21 is preferably made of a transparent plastic material and includes indicia on four sides with two sides being left blank. In the illustrated example, the cube 21 has a circle 13 on its top and a circle on its right side. A square 14 is on the front surface, while another square is on the left side. The back of the cube 21 is left blank as is the bottom of the cube. In order to identify the cubes as belonging to a particular set, the circles 13 and squares 14 are the same color.

The arrangement of circles 13, squares 14 and blanks on each of the five playing pieces or cubes 21 in a single set is shown in the following table:

| Piece # | Top | Bottom | Front | Back | Right Side | Left Side |
|---|---|---|---|---|---|---|
| | Design on sides of pieces: | | | | | |
| 1 | circle | square | square | none | none | circle |
| 2 | circle | circle | square | none | none | square |
| 3 | circle | none | square | square | none | circle |
| 4 | circle | circle | square | square | none | none |
| 5 | circle | square | square | circle | none | none |

These differences between the playing pieces are determined by the juxtaposition of circles 13, squares 14 and blanks. The sets 20 are identical to one another in the arrangement of circles 13, squares 14 and blanks, although the colors for each set are different.

The aforedescribed structure provides all of the equipment necessary to play the game in accordance with the following rules or method.

The object of the game is for a player to capture playing pieces 21 of an opponent while avoiding capture of his own playing pieces. An opponent's playing piece 21 is captured by moving a playing piece to a space 11 bordering an opponent's playing piece with the top faces of the two playing pieces matching. For example, the player with a red playing piece 21 would capture the green playing piece 21 of an opponent when the red playing piece is moved so that one of the circles 13 on the red playing piece is facing up when one of the circles 13 on the green playing piece is facing up. Only opposing pieces are subject to capture. If the upper faces do not match, no capture is effected.

Referring now to FIGS. 4 and 5, the playing pieces 21 have two moves which are used to both advance the playing pieces from one space 11 to an adjacent space and to orient the playing pieces so that selected surfaces will be up, or become top faces when the playing pieces are advanced. The first move is a rolling move wherein the playing piece 21 is rotated about either of its horizontal axes 30 or 31 through an angle of 90°. In other words, the playing piece 21 is simply tipped over about one lower edge so that one of the four side surfaces becomes a top surface and the top and bottom surfaces become side surfaces. The second move is shown in FIG. 5 wherein a playing piece is moved by rotation about a vertical axis 33. Rotation through 90°, 180° or 270° is permitted. However, a player may not rotate a playing piece through 360°.

In playing the game, each player's turn may include any combination of three roll or twist operations. Accordingly, a playing piece 21 may be manuevered on the board in any one of the following five combinations:

1. Roll three spaces;
2. Roll two spaces, then twist;
3. Twist, roll one space, then twist again;
4. Twist, then roll two spaces; or
5. Roll one space, twist, then roll another space.

A playing piece may be moved to any bordering space 11 not already occupied. After each roll, the indicia or markings do not have to match but they must match when the three-operation play is completed. For example, when a player completes his turn on a space 11 marked with a square 14, the playing piece 21 moved during the turn must have a square facing downwardly in registration with the square in the space. Likewise, if the space 11 has a circle 13, the playing piece 21 must have a circle facing downwardly at the end of a turn, and if the space is blank, then the playing piece 21 must have a blank side facing downwardly at the end of a turn. Finally, a playing piece 21 must not end up on the same space 11 that it started on at the beginning of a turn.

A player who begins a maneuver, but fails to complete that maneuver correctly, forfeits his playing piece 21 to the player who preceded him and the player loses his turn. In order to complete a maneuver correctly, a player must use any one of the three operations listed above and must end his turn on a different space 11 from that on which he started, with the indicia 13 or 14, or the blank, matching the indicia of the final space. In order to keep the game moving, there should be no restarts or second chances.

Thus far the object of the game and the restraints on selected moves of the playing pieces have been explained. In order to start the game, the areas **11*a*–11*d* outlined by the red, yellow, green and blue borders 15*a*–15*d* or the black borders 16*a*–16*d* are utilized. When two or four persons play, the starting areas are outlined by the colored borders 15*a*–15*d*. When three persons play, three starting areas are used, each outlined by the black borders 16*a*, 16*b* and 16*c*. In order to start the game, players agree on which color will make the first play and one cube 21 of each color is concealed. Concealment may be accomplished by simply holding the playing pieces in a box held overhead. The players then draw to determine their assigned colors for the game. If two or four players are playing, each player places playing pieces 21 of his color on the starting spaces assigned to that color by the appropriate borders 15. If three players are playing, then the playing pieces are placed in the areas defined by the black borders 16, each of which overlap a portion of an area defined by one of the colored borders 15*a*–15*d*. As is seen in FIG. 1, each color bordered starting area has six spaces and each black bordered starting area has five spaces. In the starting areas defined by a colored border, there are two squares 14, two circles 13 and two blanks. In the starting spaces defined by the black border, there are two squares 14, two circles 13** and one blank.

To commence playing, each player places five playing pieces 21 of his color coded set in the appropriate starting areas with the indicia of the contacting surfaces between the spaces 11 and the playing pieces 21 matching. In other words, if the space 11 has a square printed thereon, then the playing piece 21 will have a square facing downwardly or on the bottom surface thereof. If the square has a circle, then the playing piece 21 will have a circle on the bottom surface thereof, and if the square is blank, then the bottom surface of the playing piece 21 will be blank.

The player picking the color designated to start moves first my maneuvering one of his playing pieces 21 according to the aforementioned play in which a combination of three roll or twist operations is effected in accordance with the maneuvers shown in FIGS. 4 and 5. After the first player makes one play, the play moves to his left for one play and continues around the board in a clockwise direction until the game is completed. During play, the playing pieces 21 may be moved to any of the eighty-one spaces 11 on the board, regardless of the borders 15 and 16, so long as there is no playing piece 21 occupying that space 11 and provided that at the end of a turn the contacting surface of the playing piece matches the space.

In playing this game it may be desirable to keep score. In a suggested method of keeping score, one point is recorded for each playing piece 21 captured by a player or gained by forfeit, and one point is recorded for each player completely eliminated from the board before a remaining player. The last surviving player or team of players also scores one point for each playing piece 21 still on the board. In the event of a "draw", which may be agreed upon by two players who each have only one playing piece 21 remaining in play, no points are scored for the playing pieces left on the board. The player or team with the most points wins the game. Overall winners may be decided on the basis of that player or team being the first to reach a given number of points. Alternatively, the player or team having the highest point total after a given number of games, or the player or team having won the most games may be declared the overall winner.

The aforedescribed game requires but two types of apparatus, i.e. the playing pieces 21 and the board 11, is easy to learn and yet is challenging to play. The game has many of the challenges of chess or checkers and yet may be played by more than two people. It is a three-dimensional game and yet is played on a single flat surface.

The foregoing embodiment is merely illustrative of the instant invention and the invention is limited only by the following appended claims.

What is claimed is:

1. A game apparatus comprising:

a playing surface divided into a plurality of spaces;

a plurality of types of symbols marking said spaces wherein each said space has a symbol of one type associated therewith; and a plurality of playing pieces for each player for movement on the playing surface from one space to another wherein each playing piece has at least three sides, each side being marked with one type of symbol to match with the same type of symbol in the spaces on the board, such that each piece has at least three types of said symbols thereon whereby the playing pieces may be twisted and rotated about vertical and horizontal axis in order to effect playing of the game.

2. The game apparatus of claim 1 wherein the playing surface further includes color coded starting areas enclosing a plurality of spaces, and wherein the playing pieces are arranged in color coded sets wherein each set is used by a separate player.

3. The game apparatus of claim 1 or 2 wherein the playing pieces are cubes and wherein the cubes are color coded by having colored symbols thereon.

4. The game apparatus of claim 1 or 2 wherein the playing pieces are cubes made of a transparent material and wherein the cubes are color coded by having colored symbols thereon, the colored symbols of each cube being of the same color.

5. The game apparatus of claim 1 or 2 wherein the playing pieces are cubes made of transparent material and wherein the cubes are organized in color coded sets, each set being identified with a particular player, wherein the individual cubes in each set have the symbols arranged in different arrays on the faces thereof and wherein the individual cubes in each set have arrays corresponding to one individual cube in the other sets.

* * * * *